US009092004B2

(12) United States Patent
Ikeda et al.

(10) Patent No.: US 9,092,004 B2
(45) Date of Patent: Jul. 28, 2015

(54) PROCESS FOR PRODUCING END MEMBER, PROCESS FOR PRODUCING PHOTO CONDUCTOR DRUM UNIT, END MEMBER, AND PHOTO CONDUCTOR DRUM UNIT

(71) Applicant: MITSUBISHI CHEMICAL CORPORATION, Chiyoda-ku (JP)

(72) Inventors: Shuichi Ikeda, Odawara (JP); Takeshi Hiramatsu, Odawara (JP); Masakatsu Murayama, Odawara (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 13/865,566

(22) Filed: Apr. 18, 2013

(65) Prior Publication Data

US 2013/0287441 A1 Oct. 31, 2013

(30) Foreign Application Priority Data

Apr. 27, 2012 (JP) ..... 2012-103924
Jun. 29, 2012 (JP) ..... 2012-147479

(51) Int. Cl.

| | |
|---|---|
| ***G03G 21/00*** | (2006.01) |
| ***G03G 21/16*** | (2006.01) |
| ***G03G 5/00*** | (2006.01) |
| ***G03G 15/00*** | (2006.01) |
| ***G03G 5/10*** | (2006.01) |

(52) U.S. Cl.

CPC ..... *G03G 21/1671* (2013.01); *G03G 5/00* (2013.01); *G03G 5/102* (2013.01); *G03G 15/751* (2013.01); *G03G 15/757* (2013.01)

(58) Field of Classification Search

CPC ..... G03G 15/757; G03G 2215/00987; G03G 15/751; G03G 2215/00953; G03G 21/1671; G03G 5/102; G03G 5/00

USPC ..... 399/109, 159, 167; 492/47; 29/895.1, 29/895.2, 895.22; 264/36.12, 36.16

See application file for complete search history.

(56) References Cited

U.S. PATENT DOCUMENTS

| | | | | |
|---|---|---|---|---|
| 3,255,060 | A * | 6/1966 | Neumann et al. | 216/83 |
| 7,153,563 | B2 * | 12/2006 | Shoshi et al. | 428/220 |
| 7,747,189 | B2 * | 6/2010 | Shanun et al. | 399/109 |
| 7,897,315 | B2 * | 3/2011 | Takemoto et al. | 430/69 |

(Continued)

FOREIGN PATENT DOCUMENTS

| | | | |
|---|---|---|---|
| JP | 56143339 | A * | 11/1981 |
| JP | 2001-83838 | | 3/2001 |
| JP | 2003-255759 | | 9/2003 |

(Continued)

*Primary Examiner* — Robert Beatty

(74) *Attorney, Agent, or Firm* — Oblon, McClelland, Maier & Neustadt, L.L.P.

(57) ABSTRACT

There is provided a process for producing an end member capable of improving adhesiveness without not always requiring grooves or rough surfaces at a fitting portion of the end member, at the time of joining a photo conductor drum having an aluminum-made or aluminum alloy-made substrate and a crystalline resin-made end member with an adhesive. A process for producing an end member to be mounted on an end portion of a photo conductor drum and formed of a material including a crystalline resin, wherein the end member has a fitting portion to be fitted to the end portion of the photo conductor drum and the process has a step of subjecting at least an outer surface of the fitting portion to an oxidation treatment.

10 Claims, 3 Drawing Sheets

(56) References Cited

U.S. PATENT DOCUMENTS

| | | | | |
|---|---|---|---|---|
| 8,725,036 | B2 * | 5/2014 | Yamashita et al. | 399/117 |
| 2004/0084797 | A1 * | 5/2004 | Iizuka et al. | 264/104 |

FOREIGN PATENT DOCUMENTS

| | | | |
|---|---|---|---|
| JP | 2003255759 A | * | 9/2003 |
| JP | 2006171558 A | * | 6/2006 |

* cited by examiner

PROCESS FOR PRODUCING END MEMBER, PROCESS FOR PRODUCING PHOTO CONDUCTOR DRUM UNIT, END MEMBER, AND PHOTO CONDUCTOR DRUM UNIT

BACKGROUND OF THE INVENTION

The present invention relates to a process for producing a photo conductor drum unit to be used in image-forming devices such as laser printers and copiers, a process for producing an end member to be provided on the photo conductor drum unit, an end member, and a photo conductor drum unit.

A photo conductor drum is provided on image-forming devices such as laser printers and copiers. The photo conductor drum is a member for transferring contents to be represented, such as letters and graphics, to recording media such as paper. Such a photo conductor drum is composed by covering, with a sensitive layer, an outer circumferential surface of a conductive cylindrical substrate formed of aluminum or the like. The type of the photosensitive layer to be used for covering is appropriately selected depending on a device to which the photo conductor drum is applied.

On both ends of the cylindrical photo conductor drum, an end member for holding the photo conductor drum in an image-forming device and rotating the photo conductor drum around a cylinder axis. Therefore, the photo conductor drum is disposed in a state where the end member is mounted on both ends thereof as a photo conductor drum unit, in the image-forming device.

The end member is mounted to the photo conductor drum by inserting a part (fitting portion) of the end member into the inside of the cylindrical photo conductor drum and the outer surface of the fitting portion and the inner surface of the photo conductor drum are fixed with an adhesive.

Here, with regard to fixing of the substrate formed of aluminum or the like and the end member formed of a resin with an adhesive, there is a problem of adhesiveness such as exfoliation or durability against load torque (torque strength). One main cause for this problem is that there is an end member having a gear in combination and, in the case of a complex shape, it is preferred to use an easily formable resin but such a resin has a problem of adhesiveness attributable to compatibility with the adhesive.

From such a viewpoint, Patent Reference 1 discloses a technique of enhancing adhesiveness between the photo conductor drum and the end member. According to the technique, grooves are provided on the fitting portion beforehand at the time of producing the resin-made end member and the adhesiveness can be improved due to an anchoring effect.

Moreover, there is known a technique of fixing through mechanical "crimping" after the insertion of the end member into the photo conductor drum.

Furthermore, Patent References 2 and 3 disclose techniques of enhancing adhesive strength through roughening of the surface of the fitting portion by shot-blasting.

On the other hand, from the viewpoints of cost reduction, energy saving, and resource saving, it is required to reuse the end member.

PRIOR ART REFERENCE

Patent Reference

[Patent Reference 1] JP-A-2001-83838
[Patent Reference 2] U.S. Pat. No. 7,747,189
[Patent Reference 3] JP-A-2003-255759

However, owing to the requirement of high-speed printing in recent years, the environment to which the photo conductor drum unit is exposed becomes more severe and the adhesiveness cannot be said to be sufficient even when the technique described in Patent Reference 1 is applied. Moreover, also from the viewpoints of production and costs, such as necessity of forming grooves and an increase in the amount of the adhesive for being disposed in the grooves, an improvement has been desired. Furthermore, many of the reused end members do not have the grooves as described in Patent Reference 1 and thus a sufficient adhesive strength cannot be obtained when they are adhered as they are.

In addition, in the fixing of the end member by crimping, productivity decreases and, also with regard to products, there is a concern that run-out of the photo conductor drum increases or roundness of the end portion of the photo conductor drum decreases.

In the method by the blasting as in Patent References 2 and 3, there is a concern that media are collided with portions not to be processed or later steps are contaminated with dusts or the like. Moreover, for the collision of the media for blasting and surroundings thereof, a large-scale apparatus is needed. Namely, in addition to an apparatus and a step for blasting, there are steps of arranging members along steps and grasping the members and also a washing step of removing the media invaded into the members and a drying step after washing become necessary. Therefore, it is also problematic that the facilities become a large scale and productivity is poor.

SUMMARY

Accordingly, in view of the above problems, an object of the present invention is to provide a process for producing an end member capable of improving adhesiveness without not always requiring grooves or rough surfaces at a fitting portion of the end member, at the time of joining a photo conductor drum having an aluminum-made or aluminum alloy-made substrate and a crystalline resin-made end member with an adhesive, and a process for producing a photo conductor drum unit. Moreover, the invention provides an end member and a photo conductor drum unit.

It is therefore an aspect of the invention to provide a process for producing an end member to be mounted on an end portion of a photo conductor drum and to be formed of a material containing a crystalline resin, the end member having a fitting portion to be fitted to the end portion of the photo conductor drum and the process including a step of subjecting at least an outer surface of the fitting portion to an oxidation treatment.

The oxidation treatment may be an ozone treatment. The oxidation treatment may be ozone exposure or immersion in ozonated water.

The oxidation treatment may be ozone exposure and nitrogen oxides may not be substantially contained.

The oxidation treatment may be immersion in ozonated water and nitrogen oxides may not be substantially contained.

Ozone to be used in the oxidation treatment may be formed by an electrolytic method.

The crystalline resin may be polyacetal.

It is another aspect of the invention to provide a process for producing a process for producing a photo conductor drum unit comprising a process of inserting the fitting portion of the end member produced by the process for producing the end member according to any one of claims 1 to 7 into the inside of a photo conductor drum having a cylindrical substrate formed of aluminum or an aluminum alloy and a photosensitive layer laminated on the outer circumferential surface of the substrate, and adhering the outer surface of the fitting portion and the cylindrical inner surface of the photo conductor drum with an adhesive.

The adhesive may be a cyanoacrylate-based adhesive.

It is still another aspect of the invention to provide an end member to be mounted on an end portion of a cylindrical photo conductor drum, the end member having a fitting portion that is a portion to be inserted into a cylindrical inside of the photo conductor drum and being formed of a crystalline resin, wherein the fitting portion has a surface subjected to an oxidation treatment.

The crystalline resin may be a polyacetal resin.

It is still another aspect of the invention to provide a photo conductor drum unit comprising: a photo conductor drum having a cylindrical substrate formed of aluminum or an aluminum alloy and a photosensitive layer laminated on the outer circumferential surface of the substrate, and an end member formed of a crystalline resin and to be mounted on an end portion of the photo conductor drum, wherein the end member has a fitting portion to be inserted into a cylindrical inside of the photo conductor drum, the fitting portion having a surface subjected to an oxidation treatment, and the surface of the fitting portion and the inner surface of the photo conductor drum are adhered with an adhesive.

DETAILED DESCRIPTION OF EMBODIMENTS

The above-described action and advantages of the invention will be made apparent from the modes for carrying out the invention to be described below. The following will describe the invention based on the embodiments shown in Drawings. However, the invention should not be construed as being limited to these embodiments.

Figure 1:
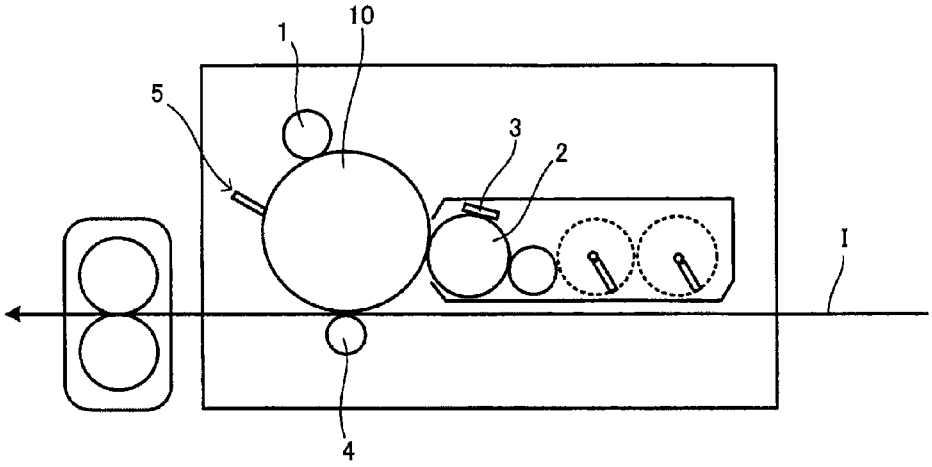
FIG. 1 is a drawing schematically illustrating the structure of an image-forming apparatus.

First, one example of the photo conductor drum unit and the end member to be provided on the photo conductor drum unit is described. FIG. 1 is a drawing schematically illustrating the inner structure of an image-forming apparatus including a photo conductor drum unit 10. As the image-forming apparatus, there may be, for example, mentioned laser printers, copiers, and facsimiles.

The image-forming apparatus possesses the photo conductor drum unit 10 (see FIG. 2), an electrifying roller 1, a developing roller 2, a restriction member 3, a transfer means 4, and a cleaning blade 5. By migrating a medium such as paper along the line shown by I in FIG. 1, an image is transferred to the medium. The following will describe each constitution.

Figure 2A:
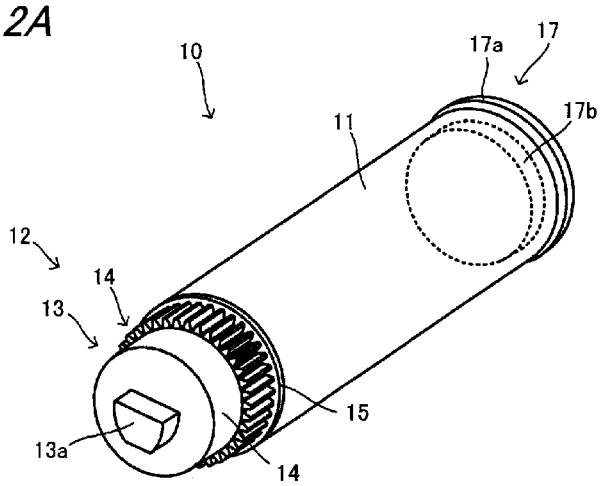
FIG. 2A is a perspective view of a photo conductor drum unit.
Figure 2B:
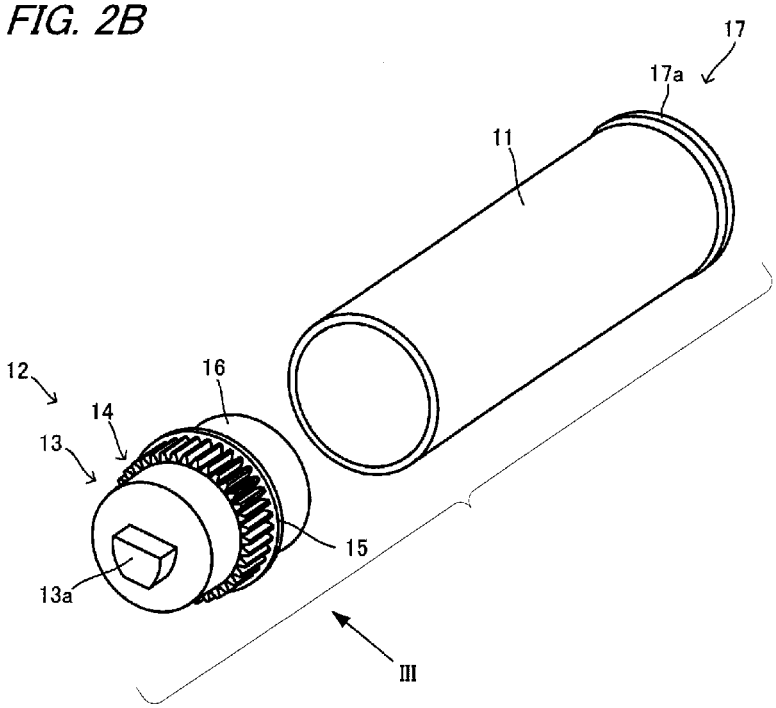
FIG. 2B is an exploded perspective view of the photo conductor drum unit shown by separating an end member at one side from the photo conductor drum.
Figure 3:
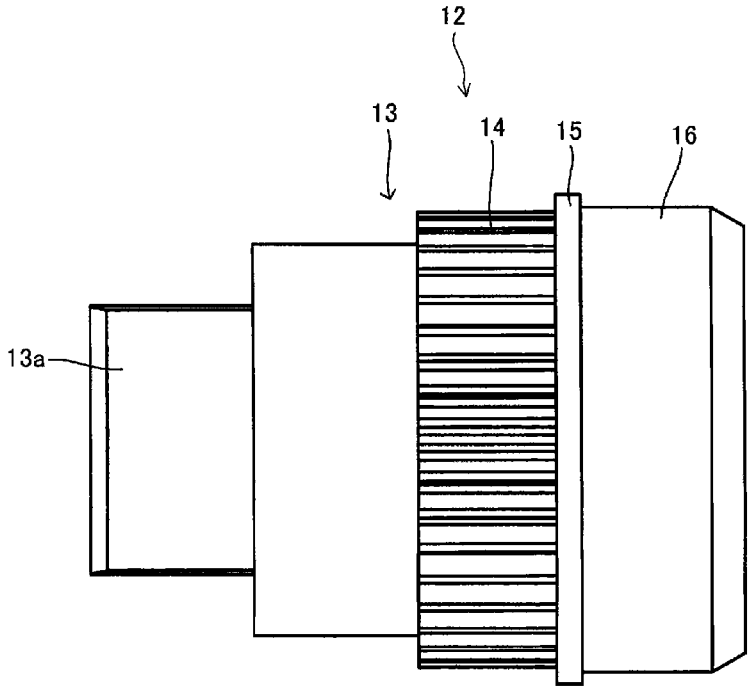
FIG. 3 is a front view in which the end member is viewed from the direction shown by III in FIG. 2.

On the photo conductor drum unit 10, letters, graphics, and the like to be transferred to the recording medium such as paper are formed on an outer circumferential surface thereof. In FIGS. 2A and 2B, perspective views of the photo conductor drum unit 10 are shown. FIG. 2A is a figure in which end members 12 and 17 are combined with the photo conductor drum unit 11 and FIG. 2B is an exploded perspective view in which the end member 12 at one side is shown with separating it from the photo conductor drum 11. Also, FIG. 3 is a front view in which the end member 12 is viewed from the direction shown by III in FIG. 2B.

As is realized from FIGS. 2A and 2B, the photo conductor drum unit 10 comprises the photo conductor drum 11, the end member 12, and the end member 17.

The photo conductor drum 11 is a member where the outer circumferential surface of a cylindrical substrate is covered with a photosensitive layer. The substrate is obtained by forming a conductive material made of aluminum or an aluminum alloy into a cylindrical shape. The photosensitive layer to be formed on the outer circumferential surface of the substrate is not particularly limited and known one can be adopted depending on a purpose thereof. The type of the aluminum alloy to be used herein is not particularly limited but is preferably any of aluminum alloys of 6000 series, 5000 series, and 3000 series defined in JIS Standard, which are frequently used as conductive supports for photo conductor drums.

The substrate can be produced through formation of a cylindrical shape by cutting, extruding, drawing, or the like. It is possible to manufacture the photo conductor drum 11 through lamination, for example, by applying the photosensitive layer on the outer circumferential surface of the substrate.

The end member 12 is one mode of an end member and is a member fitted with a gear to be attached to one end portion of end portions of the photo conductor drum 11. The end member 12 has a function of rotating the photo conductor drum unit 10 itself with receiving rotation-driving force from a rotation-driving axis of the image-forming apparatus and also transmitting the rotation force to the other roller(s) (electrifying roller 1 etc.) adjacent to the photo conductor drum unit 10 through the fitted gear. The end member 12 possesses a cylindrical body 13, a gear portion 14 provided on the outer circumferential surface of the cylindrical body 13, a contact wall 15 that comes into contact with an end surface of the photo conductor drum 11 to lock the member, and a fitting portion 16 to be inserted into the inside of the photo conductor drum 11.

The cylindrical body 13 is a closed-end cylindrical member that possesses a bottom at one end portion and has a contact wall 15 at another end portion. In the cylindrical body 13, an axis 13*a* is provided from the bottom so as to be protruded toward outside. The axis 13*a* is connected to the rotation-driving axis of the image-forming apparatus and has a function of transmitting the rotation force from the rotation-driving axis to the photo conductor drum unit 10. Therefore, the axis 13*a* has such a shape that the rotation force from the rotation-driving axis of the image-forming apparatus is efficiently transmitted to the end member 12. The shape is not particularly limited as long as it is a shape having such a function but there may be, for example, mentioned a shape that is rectangle (see FIG. 2) when the photo conductor drum unit 10 is viewed from the rotation axis direction of the photo conductor drum unit 10.

The gear portion 14 is a gear provided on the outer circumferential surface of the cylindrical body 13 and transmits the rotation force to the developing roller and the like. In the present embodiment shown in the figure, the gear portion 14 is a spur gear. However, the type of the gear is not particularly limited as long as it can achieve the purpose and the gear portion may be, for example, a helical gear or the like. However, an example having the gear portion is shown in the present embodiment but it is not always necessary to provide the gear portion on the end member.

The contact wall 15 is provided on an end portion, of the end portions of the cylindrical body 13, opposite to the side at which the axis 13*a* is provided and is a ring-shaped member stood on the outer circumferential surface of the cylindrical body 13. The contact wall 15 is disposed so as to come into contact with an end surface of the photo conductor drum 11 when the end member 12 is mounted on the photo conductor drum 11, as is realized from FIG. 2A. Thereby, the depth of insertion of the end member 12 into the photo conductor drum 11 is restricted.

The fitting portion 16 is a cylindrical portion which protrudes from a portion of the contact wall 15 opposite to the side on which the cylindrical body 13 and the gear portion 14 are provided. The fitting portion 16 is inserted into the inside of the photo conductor drum 11 and has a function of fixing the end member 12 to an end portion of the photo conductor drum 11 together with an adhesive to be mentioned later. Therefore, the outer diameter of the fitting portion 16 is about the same as the inner diameter of the photo conductor drum 11 within the range capable of being inserted into the cylindrical inside of the photo conductor drum 11.

The end member 12 is preferably formed of a crystalline resin. When it is a crystalline resin, since flow is good at injection molding using a mold, moldability is good and it can be released from the mold through crystallization and solidification without cooling to glass transition temperature. Therefore, it is possible to improve productivity to a large extent. Moreover, a crystalline resin is excellent in solvent resistance, oil resistance, and grease resistance and is good in wear and abrasion resistance and sliding ability. Furthermore, also from the viewpoints of rigidity and hardness, a crystalline resin is preferred as a material to be applied to the end member.

Examples of the crystalline resin include polyethylene, polypropylene, polyamide, polyacetal, polyethylene terephthalate, polybutylene terephthalate, methylpentene, polyphenylene sulfide, polyether ethyl ketone, polytetrafluoroethylene, and Nylon.

Of these, from the viewpoint of moldability, it is preferred to use a polyacetal-based resin.

As the polyacetal-based resin to be used herein, a polyacetal-based resin containing an oxymethylene unit (—$CH_2O$—) as a main constituent unit is preferred.

Such a polyacetal-based resin may be a polyacetal copolymer containing a unit other than the oxymethylene group and, as the unit other than the oxymethylene group, there is preferred a polyacetal copolymer containing an oxyalkylene unit having about 2 to 6 carbon atoms, preferably about 2 to 4 carbon atoms (for example, an oxyethylene group (—$CH_2CH_2O$—), an oxypropylene group, an oxytetramethylene group, or the like) as a constituent unit.

The above polyacetal copolymer may be a copolymer constituted by a plurality of components, for example, a copolymer constituted by two components, a terpolymer constituted by three components, or the like. The polyacetal copolymer is generally a random copolymer but may be a block copolymer, a graft copolymer, or the like.

The above-described polyacetal-based resin can be produced by copolymerizing trioxane or tetraoxane that is a cyclic oligomer of formaldehyde with a cyclic ether having an oxyalkylene unit having about 2 to 6 carbon atoms, such as ethylene oxide, propylene oxide, 1,3-dioxolane, or a formal of 1,4-butanediol.

To the above crystalline resin to be applied, an antioxidant (phenol-based, phosphorus-based, or sulfur-based one), a photostabilizer, a flame retardant, a pigment, a crystal nucleating agent, and the like can be added according to need. Moreover, a plurality of resins may be dissolved each other or the resin may be colored into an arbitrary color by adding a master batch. Furthermore, in order to improve sliding ability, a fluorinated resin, polyethylene, silicone rubber, or the like can be also added thereto. More specific details are as follows.

As the material to be used for the end member, in addition to the crystalline resin, almost all of known thermoplastic resins can be used in combination. Examples of the thermoplastic resins usable in combination include styrene-based resins such as polystyrene (PS) and styrene/acrylonitrile copolymer resin (SAN), acrylic vinyl polymers such as polymethyl methacrylate (PMMA), polyolefin resins such as polyethylene (PE) and polypropylene (PP), polyvinyl chloride resin (PVC), polyphenylene ether resin (PPE) and modified products thereof, aromatic polyester resins (PET, PBT), polycarbonate resins (PC), and polyamide resins (PA) such as polycapramide (Nylon 6) and polyhexamethyleneadipamide (Nylon 66). They may be used singly or two or more thereof may be used in combination. Moreover, a compatibility accelerator such as a graft copolymer may be also used in combination.

In addition, a rubber polymer of core-shell type, elastomer, or the like may be also blended. Specific examples thereof include diene-based core-shell type rubber polymers such as methyl methacrylate/butadiene/styrene copolymer resin (MBS resin) and acrylonitrile/butadiene/styrene copolymer resin (ABS resin), acrylic core-shell type rubber polymers such as acrylate/styrene/acrylonitrile copolymer resin (ASA resin) and acrylate/methyl methacrylate copolymer resin, silicone-based core-shell type rubber polymers such as silicone/acrylate/methyl methacrylate copolymer resin and silicone/acrylate/acrylonitrile/styrene copolymer resin, olefinic thermoplastic elastomers (TPO) such as ethylene/propylene copolymer (EPR), ethylene/butene-1 copolymer, ethylene/propylene/non-conjugated diene copolymer (EPDM), ethylene/vinyl acetate copolymer (EVA), and ethylene/ethyl acrylate copolymer (EEA), styrene-based thermoplastic elastomers (TPE) such as styrene/butadiene/styrene block copolymer (SBS), styrene/ethylene/butylene/styrene block copolymer (SEBS), styrene/ethylene/propylene block copolymer (SEP), and styrene/isoprene/styrene block copolymer (SIS), and modified products thereof with maleic anhydride, glycidyl methacrylate, or the like, thermoplastic polyesters (TPEs), thermoplastic polyurethane (TPU), isobutene/isoprene rubber (IIR), polyisoprene (IR), natural rubber (NR), butadiene/acrylonitrile copolymer (NBR), and butadiene/styrene copolymer (SBR). They may be used singly or two or more thereof may be used in combination.

In addition, various additives may be blended into the material of the end member according to need within the range where intrinsic properties of the crystalline resin is not impaired. Specific examples thereof include pigments and dyes, reinforcing agents and fillers such as glass fibers, metal fibers, metal flakes, and carbon fibers, phenol-based antioxidants such as 2,6-di-tert-butyl-4-methylphenol and 4,4'-butylidene-bis(3-methyl-6-t-butylphenol), phosphite-based antioxidants such as tris(mixed, mono and di-nylphenyl) phosphite and diphenyl isodecyl phosphite, sulfur-based antioxidants such as dilaurylthio dipropionate, dimyristylthio dipropionate, and distearylthio dipropionate, 2-hydroxy-4-octoxybenzophenone, benzotriazole-based ultraviolet absorbents such as 2-(2-hydroxy-5-methylphenyl)benzotriazole, photostabilizers such as bis((2,2,6,6)-tetramethyl-4-piperidinyl), antistatic agents such as hydroxylalkylamine and sulfonate salts, lubricants such as ethylene-bis-stearylamide and metal soaps, and flame retardants such as tetrabromophenol A, decabromophenol oxide, TBA epoxy oligomers, TBA polycarbonate oligomers, antimony trioxide, TPP, and phosphate esters. Blending of such various additives can achieve adjustment to more desirable physical properties and characteristics.

At the fitting portion 16 of the end member 12, grooves or rough surfaces for improving adhesiveness may be provided beforehand or may not be provided. This is because the improvement in adhesiveness is particularly remarkable in the case where the grooves or rough surfaces are not present but there is an effect of further improvement in adhesiveness even when the grooves or rough surfaces are provided.

Moreover, in the end member 12, at least an outer surface of the fitting portion 16 is a surface subjected to an oxidation treatment (oxidation-treated surface). Thereby, even in the case of a crystalline resin that is problematic in adhesiveness, the surface is activated and the adhesiveness to the photo conductor drum 11 with the adhesive to be mentioned later can be improved. Namely, the end member acquires a sufficient adhesiveness without forming grooves or rough surfaces at the fitting portion as before.

The end member 17 is an end member to be mounted on an end portion, of the end portions of the photo conductor drum 11, opposite to the side at which the end member 12 is disposed. The end member 17 is one mode of the end member although the gear portion is not provided. Therefore, as the material, those the same as the end member 12 can be used.

The end member 17 comprises a bearing portion 17*a* that has a disk shape and a fitting portion 17*b* (shown by a dashed line in a perspective manner in FIG. 2A) that protrudes from the face of the bearing portion 17*a* toward the inside of the photo conductor drum 11. In the end member 17, the fitting portion 17*b* to be fitted to the cylinder inside of the photo conductor drum 11 and the bearing portion 17*a* to be disposed so as to cover one end surface of the photo conductor drum 11 are formed coaxially. Here, the bearing portion 17*a* is a disk shape that covers the end surface of the photo conductor drum 11 and also possesses a portion that receives an axis, the portion being not shown in the figure. Moreover, an earth plate composed of a conductive material, which is not shown in the figure, is disposed on the end member 17, thereby connecting the photo conductor drum 11 and the image-forming apparatus itself electrically. In the present embodiment, the example where the earth plate is disposed on the end member 17 is described but, without limitation thereto, the earth plate may be disposed on the end member 12 side.

Moreover, in the present embodiment, also in the end member 17, at least an outer surface of the fitting portion 17*b* is a surface subjected to an oxidation treatment (oxidation-treated surface) as in the case of the end member 12. Thereby, even in the case of a crystalline resin that is problematic in adhesiveness, the surface is activated and the adhesiveness to the photo conductor drum 11 with the adhesive to be mentioned later can be improved. Namely, the end member acquires a sufficient adhesiveness without forming grooves or rough surfaces at the fitting portion as before.

The photo conductor drum 11 and the end members 12 and 17 are fixed with an adhesive. Namely, they are fixed with the adhesive provided between the outer circumferential surface of the fitting portions 16 and 17*b* of the end members 12 and 17 to be inserted into the inside of the photo conductor drum 11 and the inner circumference of the photo conductor drum 11.

As the adhesive to be used, it is preferred to use a cyanoacrylate-based, polyurethane-based, or acrylic resin-based one. Of these, particularly, a cyanoacrylate-based adhesive exhibiting a fast curing rate is preferred since it is rapidly cured by the action of surrounding moisture.

The end members 12 and 17 and the photo conductor drum unit 10 containing them can be, for example, produced as follows.

In the present example, at the time of producing the end members 12 and 17, end members (end members before treatment) composed of a crystalline resin are prepared, the members being the same as before. The end members before treatment may be newly produced ones or reused ones. With regard to the newly produced ones, the production process thereof is not particularly limited and the members can be manufactured, for example, by injection molding or the like.

Next, there is performed an oxidation treatment of increasing oxygen concentration of at least an outer surface of the portion, which is to be a fitting portion, of the end member before treatment. Before the oxidation treatment, it is preferred to wash the surface of the end member before the treatment. The washing method is not particularly limited and a known method can be applied.

The method for the oxidation treatment is not particularly limited and any method can be adopted. However, for example, it can be considered with separation into a step of ozone generation and a step of ozone treatment.

The step of ozone generation is a step of generating ozone to be brought into contact with the end member. For this purpose, for example, ozone generation by silent discharge, ultraviolet irradiation, or electrolysis can be mentioned.

The ozone generation by silent discharge is a method of generating ozone from oxygen in the air by the energy of corona discharge through generation of the corona discharge in the air.

The ozone generation by ultraviolet irradiation is a method of generating ozone from oxygen in the air by the energy of ultraviolet rays through irradiation of the air with the ultraviolet rays.

The ozone generation by electrolysis is also called an electrolytic method and ozone is generated by electrolyzing diluted sulfuric acid, for example, using a graphite electrode as a negative electrode and a platinum electrode as a positive electrode. On this occasion, ozone is formed from the positive electrode.

According to the ozone generation by electrolysis, nitrogen oxides (e.g., nitric anhydride ($N_2O_5$)) are not generated along with the generation of ozone and thus discoloration of the end member can be suppressed when the end member is subjected to an ozone treatment in the step of ozone treatment.

Here, the method of ozone generation is not particularly limited but it is preferred to use a method where nitrogen oxides are not formed at ozone generation. Thereby, the discoloration of the end member after the step of ozone treatment of the end member can be suppressed. For example, in the ozone generation by silent discharge, nitric anhydride ($N_2O_5$) is generated along with ozone and nitric anhydride absorbs water vapor to form nitric acid ($HNO_3$). Thereby, when the end member is subjected to the ozone treatment, it is considered that nitric acid is decomposed by light ($4HNO_3$+light–>$4NO_2+2H_2O+O_2$) to discolor (yellow) the end member.

The step of ozone treatment is a step of treating at least a surface of the fitting portion of the end member by bringing the surface into contact with ozone using ozone generated in the above step of ozone generation. As the step of ozone treatment, there may be mentioned a method by ozone exposure and a method by immersion in ozonated water.

The method of ozone exposure is sometimes called a vapor-phase method and is a method of treatment by exposing the end member to a gas atmosphere containing ozone. For example, the method can be carried out by exposing the end member into a chamber of an air atmosphere containing ozone. In the case where the formation of ozone is achieved by silent discharge or ultraviolet irradiation, the step of ozone generation and the step of ozone treatment can be simultaneously carried out when the silent discharge or the ultraviolet irradiation is performed in a state that the end member is placed in the chamber.

The method by immersion in ozonated water is sometimes called a liquid-phase method and is carried out by immersing the end member before treatment in a tank in which ozonated water that is water having a predetermined ozone concentration is stored. The production of the ozonated water can be performed by a known method using ozone generated by the above step of ozone generation.

In the step of ozone treatment, a higher effect of improving the adhesiveness is observed when temperature at the treatment is higher and time for the treatment is longer even when either method is applied. However, depending on the degree, since there is a case where a decrease in resin performance attributable to deterioration of the surface of the resin constituting the end member becomes remarkable, suitable conditions should be set depending on the type or the like of the resin employed.

For example, in the case where it is considered to perform an efficient treatment for a short period of several minutes to several ten minutes, the ozone concentration is preferably 1 ppm or more and more preferably 10 ppm or more for obtaining a sufficient adhesive force. Also, as the temperature at the treatment on that occasion, it is possible to perform the treatment at an ordinary temperature of 20° C. to 25° C. but the temperature is preferably 30° C. or higher and more preferably 40° C. or higher.

Moreover, as mentioned above, in the step of ozone treatment, preferably, the nitrogen oxides are substantially not contained form the viewpoint of suppressing the discoloration of the end member. However, such a degree that unintended nitrogen oxides are inevitably mixed in can be allowable.

By such a treatment, a molecular chain of the material at the ozone-treated surface portion of the end member is cleaved by the action of ozone to form —OH, —COOH, and the like, so that the surface of the end member is activated. Thereby, it is considered that the adhesiveness with the adhesive is improved.

In the step of ozone treatment, the whole portion of the end member may be treated or only a part thereof, for example, only the fitting portion may be treated. As a method of treating only a part of the end member, a method of exposing only a portion to be treated in the chamber may be mentioned in the vapor-phase method. On the other hand, in the liquid-phase method, there may be mentioned a method of immersing a portion to be treated in an ozonated water layer as in the case of the vapor-phase method and a method of limiting a liquid level thereof to the portion to be treated.

On the other hand, of the inner surface end portions of the photo conductor drum 11, an adhesive is applied to portions into which the fitting portions 16 and 17 of the end members 12 and 17 are inserted. Here, as the adhesive to be used, it is preferred to use cyanoacrylate-based, polyurethane-based, or acrylic resin-based one. Of these, particularly, a cyanoacrylate-based adhesive exhibiting a fast curing rate is preferred since it is rapidly cured by the action of surrounding moisture.

Then, the fitting portions 16 and 17*b* of the end members 12 and 17 produced in the above are inserted from respective end portions of the photo conductor drum 11 to the inside. On this occasion, the end member 12 and the end member 17 are inserted until the contact wall portion 15 in the case of the end member 12 and the bearing portion 17*a* in the case of the end member 17 come into contact with respective end surfaces of the photo conductor drum 11.

In the invention, since the oxygen concentration on the outer surfaces of the fitting portions 16 and 17*b* is increased and the surface is activated as described above, it becomes possible to adhere the end members 12 and 17 to the photo conductor drum 11 in a high adhesiveness. Therefore, a sufficient adhesiveness can be obtained without providing grooves or rough surfaces on the fitting portions. Moreover, with regard to reused end members having no grooves and rough surfaces, the adhesiveness can be improved only by subjecting them to the above treatment.

Returning to FIG. 1, the structure of the image-forming apparatus will be described. In the image-forming apparatus, as described above, in addition to the photo conductor drum unit 10, there are the electrifying roller 1, the developing roller 2, the restriction member 3, the transfer means 4, and the cleaning blade 5, and each of them is as follows.

The electrifying roller 1 charges the photo conductor drum 11 by voltage impression from the image-forming apparatus. This is achieved by rotating the electrifying roller 1 with following the photo conductor drum 11 and bringing the roller into contact with the outer circumferential surface of the photo conductor drum 11.

The developing roller 2 is a roller that feeds a developing agent to the photo conductor drum 11. By the developing roller 2, electrostatic latent images formed on the photo conductor drum 11 are developed. In this regard, the developing roller 2 has a stationary magnet built-in.

The restriction member 3 is a member that adjusts the amount of the developing agent to be attached onto the outer circumferential surface of the above developing roller 2 and also imparts frictional electrification charges to the developing agent itself.

The transfer means 4 is a roller for transferring the images formed on the photo conductor drum 11 to a recording medium such as paper.

The cleaning blade 5 is a blade that comes into contact with the outer circumferential surface of the photo conductor drum 11 to remove remaining developing agent after transfer with an edge thereof.

Main rollers and blade to be provided on the image-forming apparatus are described here but members to be provided thereon are not limited thereto and the other members, portions, developing agent, and the like usually included in the image-forming apparatus are preferably provided thereon.

The following will describe motions of the image-forming apparatus. At the time when the image-forming apparatus is operated, the axis 13*a* of the above photo conductor drum unit 10 is connected to the rotation axis provided on the image-forming apparatus and is rotated according to need. The above electrifying roller 1, developing roller 2, transfer means 4, and the like are constituted so as to be rotated with receiving rotation force from the gear portion 15 of the end member 12 directly or indirectly. Thereby, the photo conductor drum unit 10 is rotated and the photo conductor drum 11 is charged by the electrifying roller 1.

In the state that the photo conductor drum unit 10 is rotated, a laser light corresponding to an image information is applied to the photo conductor drum 11 using any of various optical members not shown in the figure to obtain electrostatic latent images based on the image information. The latent images are developed by the developing roller 2.

On the other hand, the recording medium such as paper is set at the other portion of the image-forming apparatus, conveyed to a transfer position by means of a delivery roller, a conveying roller, and the like provided on the image-forming apparatus, and migrated along the line I in FIG. 1. At the transfer position, the transfer means 4 is disposed and images are transferred from the photo conductor drum 11 to the recording medium through voltage impression on the transfer means 4 with the passage of the recording medium. Thereafter, the images are fixed on the recording medium by applying heat and pressure to the recording medium. Then, the recording medium on which the images are formed is discharged from the image-forming apparatus itself.

Moreover, in the photo conductor drum 11, against next images, the cleaning blade 5 comes into contact with the outer circumferential surface of the photo conductor drum 11 to remove the remaining developing agent after transfer with an edge thereof. The developing agent scraped by the cleaning blade 5 is discharged in a known manner.

Also from the operation of the image-forming apparatus, it is understood that the photo conductor drum 11 is placed under such severe conditions that a large load is applied through repeated rotation and stoppage and charging, heating, and the like are also applied. According to the invention, as mentioned above, the adhesiveness between the photo conductor drum and the end member can be improved without providing grooves and rough surfaces at the fitting portion of the end member and also it is possible to enhance reliability of the image-forming apparatus.

EXAMPLES

<Production of End Member>

An end member formed of a polyacetal resin having an outer diameter of 28.5 mm (Asahi Kasei Corporation, LA543) was formed and subjected to an oxidation treatment. Any grooves and rough surfaces were not provided on the surface of a fitting portion thereof and the fitting portion had a smooth cylindrical face.

In Examples 1 and 2, ozone was generated by electrolysis in the step of ozone generation to form an ozone-containing gas containing a moist atmosphere (a mixed gas of $O_3$, $O_2$, and $H_2O$). In the step of ozone treatment, treatment was performed by the method of ozone exposure. Specifically, in Example 1, the end member was placed in a glass flask (3 L) and the formed mixed gas was passed through the glass flask using dry air as a carrier gas. In Example 2, the end member was also placed in a glass flask (3 L) and an ozone gas of 50,000 ppm that was a high concentration was injected by means of a syringe so that ozone concentration inside the flask became 500 ppm and the flask was allowed to stand for 180 minutes without passing through.

Also in Examples 3 and 4, ozone was generated by electrolysis in the step of ozone generation to form an ozone-containing gas containing a moist atmosphere (amixed gas of $O_3$, $O_2$, and $H_2O$). In the step of ozone treatment, treatment was performed by the method of immersion in ozonated water. Specifically, the formed mixed gas was dissolved in ultrapure water to form ozonated water, the ozonated water was circulated into a glass beaker in a flow rate of 8 L/minute and the end member was placed therein. The concentration of the ozonated water was monitored at the pre-stage of the beaker. Incidentally, in order to facilitate the dissolution of ozone, carbon dioxide gas was dissolved in the ultrapure water at the pre-stage of ozone dissolution at the preparation of the ozonated water.

For the formation of ozone gas in Examples 1 to 4, an electrolytic ozone generator "Ozone Master" manufactured by Sasakura Engineering Co., Ltd. was used. Therefore, in Examples 1 to 4, nitrogen oxides were substantially not contained.

In Examples 5 to 8, in the step of ozone generation, oxygen in the air was converted into ozone by silent discharge using dry air as a raw material using an ozone generator "CEA-1000" manufactured by Ebara Jitsugyo Co., Ltd. Then, in the step of ozone treatment, the end member was placed in a stainless steel-made chamber and the prepared ozone gas was introduced. Each ozone concentration was attained by controlling discharge intensity (voltage).

Since ozone was thus generated, nitrogen oxides were contained in Examples 5 to 8.

In Comparative Example 1, no oxidation treatment was performed.

In Comparative Example 2, blasting was performed against the fitting portion that is a smooth cylindrical face of the end member by injection for 10 seconds in total using New Glass Beads #80 manufactured by Kyoei Abrasive Materials Co., Ltd. as media for blasting using SG-106 manufactured by Hozan Tool Ind. Co., Ltd. as a blasting apparatus to obtain an end member.

Table 1 shows conditions such as ozone concentration and exposure time or immersion time and the other conditions in each of Examples and Comparative Examples.

TABLE 1

| | | | | Treatment conditions | |
|---|---|---|---|---|---|
| | Step of ozone generation | Inclusion of nitrogen oxides | Step of ozone treatment | Ozone concentration | Exposure or immersion time |
| Example 1 | electrolytic method | no | placed in chamber | 50000 ppm | 98 minutes |
| Example 2 | electrolytic method | no | placed in chamber | 500 ppm | 180 minutes |
| Example 3 | electrolytic method | no | immersion in ozonated water (50° C.) | 90 ppm | 175 minutes |
| Example 4 | electrolytic method | no | immersion in ozonated water (50° C.) | 90 ppm | 10 minutes |
| Example 5 | silent discharge | yes | placed in chamber | 500 ppm | 60 minutes |
| Example 6 | silent discharge | yes | placed in chamber | 500 ppm | 180 minutes |
| Example 7 | silent discharge | yes | placed in chamber | 100 ppm | 60 minutes |
| Example 8 | silent discharge | yes | placed in chamber | 100 ppm | 180 minutes |
| Comparative Example 1 | | | no oxidation treatment | | |

TABLE 1-continued

| | Step of ozone generation | Inclusion of nitrogen oxides | Step of ozone treatment | Treatment conditions: Ozone concentration | Treatment conditions: Exposure or immersion time |
|---|---|---|---|---|---|
| Comparative Example 2 | no oxidation treatment (blasting) | | | | |

<Production of Photo Conductor Drum Unit>

A cyanoacrylate-based adhesive was applied in an amount of 0.1 g to the fitting portion of each of the end members according to Examples 1 to 8 and Comparative Example 1 and the member was inserted into a substrate for photo conductor drum formed of an aluminum cut pipe and adhered. Thereafter, drying was performed at 35° C. under a humidity of 85% for 24 hours or more. Since a photosensitive layer is unnecessary at this time, tests were performed using the substrate without providing any photosensitive layer.

<Adhesiveness Test: Torque Measurement Test>

As a test for evaluating adhesiveness, torque strength was measured. Specific method is as follows. A cycle of −20° C. for 2 hours and 40° C. for 2 hours was determined as one cycle and a sample was held during a heat cycle in which the above cycle was repeated five times. Thereafter, torque strength of the photo conductor drum unit was measured four times per each sample using a torque measurement tester (Ono Seiki Co., Ltd., TS-3600A) and the values were averaged. Table 2 shows individual results.

<Evaluation of Discoloration>

Discoloration was visually evaluated. A case were no discoloration was observed was evaluated as "excellent", a case where discoloration was observed within an allowable range was evaluated as "good, a case where discoloration was observed beyond the allowable range was evaluated as "moderate", and a case where discoloration was observed beyond the allowable range and severe discoloration was observed was evaluated as "bad". Table 2 shows results thereof.

As is realized from the above, a sufficient torque strength, i.e., adhesive strength can be obtained by performing the oxidation treatment. From the viewpoint of obtaining adhesive strength, it is realized that any oxidation method is applicable. However, from the viewpoint of discoloration of the end member, Examples 1 to 4 in which nitrogen oxides were not contained were satisfactory. Moreover, average torque strength was certainly low in the untreated one (Comparative Example 1) and is still low and insufficient even in the case where the blast treatment was performed (Comparative Example 2) as compared with the case where the oxidation treatment was performed.

According to the present invention, at the time of joining a photo conductor drum having an aluminum-made or aluminum alloy-made substrate and a crystalline resin-made end member with an adhesive, adhesiveness can be improved, without not always requiring grooves or rough surfaces at a fitting portion of the end member, due to activation by enhanced oxygen concentration at the fitting portion.

In addition, at the improvement of the adhesiveness, a plurality of members can be placed in a chamber or a tank and a large quantity thereof can be processed batch-wise, so that productivity is also excellent.

What is claimed is:

1. A process for producing an end member adapted for mounting on an end portion of a photo conductor drum and formed of a material containing a crystalline resin which is a polyacetal resin, wherein

TABLE 2

| | Processing/ treatment | Processing/ treatment conditions | Torque strength (kg-weight cm) | | | | Average torque strength (kg-weight cm) | Discoloration |
|---|---|---|---|---|---|---|---|---|
| Example 1 | ozone gas by electrolytic method | 500000 ppm, 98 minutes | 97 | 119 | 72 | 148 | 109 | excellent |
| Example 2 | ozone gas by electrolytic method | 500 ppm, 180 minutes | 129 | 105 | 89 | 146 | 117 | excellent |
| Example 3 | ozonated water by electrolytic method | 90 ppm, 50° C., 175 minutes | 190 or more | 190 or more | 190 or more | 190 or more | 190 or more | excellent |
| Example 4 | ozonated water by electrolytic method | 90 ppm, 50° C., 10 minutes | 134 | 166 | 93 | 170 | 141 | excellent |
| Example 5 | ozone gas by discharge | 500 ppm, 60 minutes | 131 | 128 | 89 | 103 | 113 | moderate |
| Example 6 | ozone gas by discharge | 500 ppm, 180 minutes | 118 | 166 | 184 | 185 | 163 | bad |
| Example 7 | ozone gas by discharge | 100 ppm, 60 minutes | 190 or more | 141 | 182 | 155 | 120 | good |
| Example 8 | ozone gas by discharge | 100 ppm, 180 minutes | 158 | 167 | 106 | 117 | 137 | moderate |
| Comparative Example 1 | untreated | untreated | not adhered | | | | 0 | excellent |
| Comparative Example 2 | blast treatment | Nylon chip media, 5 to 10 seconds | 92 | 56 | 94 | 77 | 80 | excellent |

the end member having a fitting portion adapted for fitting to the end portion of the photo conductor drum, and the process comprising subjecting at least an outer surface of the fitting portion to an oxidation treatment which is an ozone treatment, wherein the ozone treatment is one of the following:

ozone exposure or immersion in ozonated water, ozone exposure and nitrogen oxides are substantially not contained, or immersion in ozonated water and nitrogen oxides are substantially not contained.

2. The process for producing an end member according to claim 1, wherein the ozone treatment is ozone exposure and nitrogen oxides are substantially not contained.

3. The process for producing an end member according to claim 1, wherein the ozone treatment is immersion in ozonated water and nitrogen oxides are substantially not contained.

4. The process for producing an end member process according to claim 1, wherein ozone to be used in the oxidation treatment is formed by an electrolytic method.

5. A process for producing a photo conductor drum unit comprising a process of inserting the fitting portion of the end member produced by the process for producing the end member according to claim 1 into the inside of a photo conductor drum having a cylindrical substrate formed of aluminum or an aluminum alloy and a photosensitive layer laminated on the outer circumferential surface of the substrate, and adhering the outer surface of the fitting portion and the cylindrical inner surface of the photo conductor drum with an adhesive.

6. The process for producing a photo conductor drum unit according to claim 5, wherein the adhesive is a cyanoacrylate-based adhesive.

7. An end member to be mounted on an end portion of a cylindrical photo conductor drum, the end member having a fitting portion that is a portion adapted for inserting into a cylindrical inside of the photo conductor drum and being formed of a crystalline resin which is a polyacetal resin, wherein the fitting portion has a surface subjected to an oxidation treatment which is an ozone treatment, and wherein the ozone treatment is one of the following:

ozone exposure or immersion in ozonated water, ozone exposure and nitrogen oxides are substantially not contained, or immersion in ozonated water and nitrogen oxides are substantially not contained.

8. A photo conductor drum unit comprising:

a photo conductor drum having a cylindrical substrate formed of aluminum or an aluminum alloy and a photosensitive layer laminated on the outer circumferential surface of the substrate, and an end member formed of a crystalline resin which is a polyacetal resin and mounted on an end portion of the photo conductor drum, wherein the end member has a fitting portion inserted into a cylindrical inside of the photo conductor drum, the fitting portion having a surface subjected to an oxidation treatment which is an ozone treatment, and the surface of the fitting portion and the inner surface of the photo conductor drum are adhered with an adhesive, wherein the ozone treatment is one of the following:

ozone exposure or immersion in ozonated water, ozone exposure and nitrogen oxides are substantially not contained, or immersion in ozonated water and nitrogen oxides are substantially not contained.

9. The photo conductor drum unit according to claim 8, wherein the adhesive is a cyanoacrylate-based adhesive.

10. The process for producing an end member according to claim 1, wherein the ozone treatment is ozone exposure or immersion in ozonated water.

* * * * *